US009248690B2

(12) United States Patent
Lira-Nunez et al.

(10) Patent No.: US 9,248,690 B2
(45) Date of Patent: Feb. 2, 2016

(54) NIB ASSEMBLY HAVING A DOUBLE WALL AND WRITING INSTRUMENT COMPRISING SAME

(75) Inventors: Carmen O. Lira-Nunez, Downers Grove, IL (US); Katherine J. Radville, La Grange Park, IL (US); Andrew M. Bielecki, Evanston, IL (US)

(73) Assignee: SANFORD, L.P., Downers Grove, IL (US)

( * ) Notice: Subject to any disclaimer, the term of this patent is extended or adjusted under 35 U.S.C. 154(b) by 777 days.

(21) Appl. No.: 13/404,964

(22) Filed: Feb. 24, 2012

(65) Prior Publication Data

US 2013/0223916 A1 Aug. 29, 2013

(51) Int. Cl.
*B43K 23/12* (2006.01)

(52) U.S. Cl.
CPC ..... *B43K 23/12* (2013.01)

(58) Field of Classification Search
CPC ..... B43K 23/10; B43K 23/12; B43K 23/122; B43K 23/124; B43K 23/126; B43K 23/128
USPC ..... 401/243, 244, 245, 246, 247, 202
See application file for complete search history.

(56) References Cited

U.S. PATENT DOCUMENTS

| | | | | | |
|---|---|---|---|---|---|
| 2,140,559 | A * | 12/1938 | Scully et al. | ..... | 116/109 |
| 2,498,166 | A * | 2/1950 | Kuriyama | ..... | 401/104 |
| 3,221,360 | A * | 12/1965 | Seeman | ..... | 401/102 |
| 4,455,101 | A * | 6/1984 | Malamoud | ..... | 401/243 |
| 5,297,883 | A * | 3/1994 | Ozu | ..... | 401/202 |
| 5,451,114 | A | 9/1995 | Ishigaki | | |
| 5,876,140 | A | 3/1999 | Kuramoto et al. | | |
| 2005/0008421 | A1 * | 1/2005 | Oike | ..... | 401/246 |
| 2008/0286033 | A1 * | 11/2008 | Geithner et al. | ..... | 401/243 |

FOREIGN PATENT DOCUMENTS

| | | |
|---|---|---|
| DE | 3441435 A1 | 8/1985 |
| FR | 2600976 A1 | 1/1988 |

OTHER PUBLICATIONS

Photograph of Kat Von D liner, publicly available before Feb. 24, 2012.
Photograph of Stained by Sharpie, publicly available before Feb. 24, 2012.
Photograph of Crayola Paint Brush, publicly available before Feb. 24, 2012.
Photograph of TUL Liquid Highlighter, publicly available before Feb. 24, 2012.

(Continued)

*Primary Examiner* — David Walczak
*Assistant Examiner* — Joshua Wiljanen
(74) *Attorney, Agent, or Firm* — Marshall, Gerstein & Borun LLP

(57) ABSTRACT

A nib assembly for a writing instrument comprises a ferrule having a first end and a second end. The ferrule includes an inner ferrule wall and an outer ferrule wall, the inner ferrule wall and the outer ferrule wall being separated by a well having an opening. A cap has a first end, a second end, and a first cap wall. The first cap wall is sized and shaped to be at least partially received within the well, the first cap wall being disposed at least partially within the well, between the inner ferrule wall and the outer ferrule wall, when the cap is coupled to the ferrule.

11 Claims, 4 Drawing Sheets

(56) References Cited

OTHER PUBLICATIONS

Photograph of Zebra Brush Tip Pen, publicly available before Feb. 24, 2012.

International Search Report and Written Opinion for corresponding international application No. PCT/US2012/070954, mailing date Mar. 27, 2013.

* cited by examiner

NIB ASSEMBLY HAVING A DOUBLE WALL AND WRITING INSTRUMENT COMPRISING SAME

BACKGROUND

1. Field of the Disclosure

The invention generally relates to a nib assembly for a writing instrument and more specifically to a nib assembly having a ferrule including a double wall to prevent transfer of ink from an inner surface of a cap to a gripping surface of the ferrule.

2. Related Technology

As is well known, writing instruments include a writing nib that extends from a barrel or body. The writing nib is often protected from the environment by a cap when not in use. The cap can also prevent or minimize evaporation of the volatile compounds (most typically solvents) often found in inks from the writing nib. More volatile inks are often delivered by a porous or fibrous writing nib. Some inks may be delivered by a brush-type writing nib. Examples of such writing instruments include so called "paint brush markers" having a flexible layered writing nib that produces a brush-like stroke of ink.

Some writing instruments have included a movable inner cap to provide a secondary seal between the cap and the writing nib. The movable inner cap is slidable along a longitudinal cap axis and biased towards the cap opening by a spring. While such an arrangement provides an additional seal between the movable inner cap and the ferrule, this type of arrangement greatly increases the manufacturing complexity and costs.

SUMMARY OF THE DISCLOSURE

In one embodiment, a nib assembly for a writing instrument comprises a ferrule having a first end and a second end. The ferrule including an inner ferrule wall and an outer ferrule wall, the inner ferrule wall and the outer ferrule wall being separated by a well having an opening. A cap has a first end, a second end, and a first cap wall. The first cap wall is sized and shaped to be at least partially received within the well. The first cap wall is disposed at least partially within the well, between the inner ferrule wall and the outer ferrule wall, when the cap is coupled to the ferrule.

In another embodiment a writing instrument comprises a barrel having an opening at a first end and a hollow central core. An ink reservoir is disposed within the hollow central core. A ferrule is coupled to the barrel and has a first ferrule end and a second ferrule end. The ferrule has a double wall including an inner ferrule wall and an outer ferrule wall, the space between the inner ferrule wall and the outer ferrule wall forming a well with an opening. A nib is disposed at least partially within the inner ferrule wall, the nib being in fluid communication with the ink reservoir. A cap has a first cap end and a second cap end and an opening proximate the first cap end that is formed by a first cap wall. The first cap wall is sized and shaped to fit at least partially within the well, between the inner ferrule wall and the outer ferrule wall, when the cap is coupled to the ferrule.

DETAILED DESCRIPTION

Figure 1:
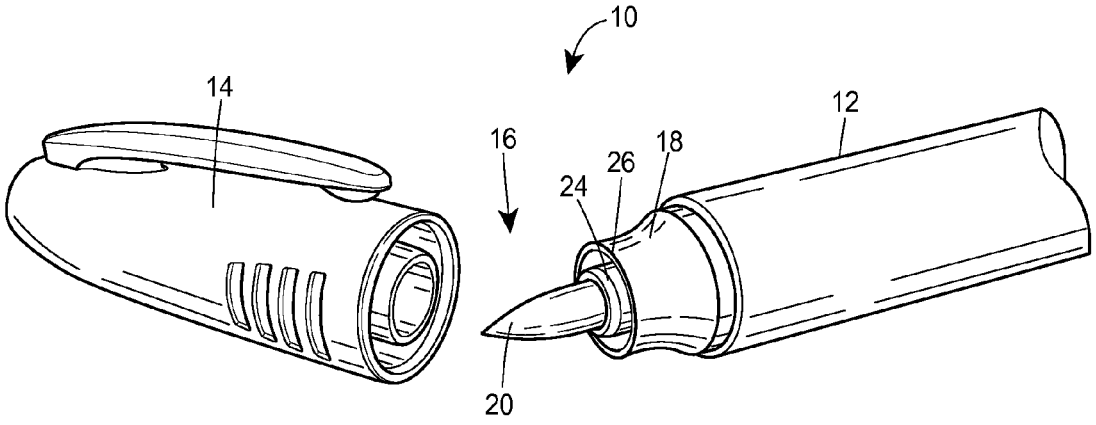
FIG. 1 is a perspective view of a writing instrument including a nib assembly having a ferrule with a double wall.

A problem has been discovered when using a brush-type writing instrument in that ink may be transferred from the writing nib to an inner cap surface and subsequently to a gripping surface (e.g., an outer surface of a ferrule or an outer surface of a barrel) when the cap is repeatedly closed and opened because the cap and the barrel may not be precisely aligned. This imprecise alignment causes the writing nib to contact an inner surface of the cap. During this contact, ink may be transferred from the writing nib to the inner surface of the cap. As the cap slides down the barrel during the closing movement, the portion of the inner surface of the cap containing the transferred ink may eventually contact an outer surface of the ferrule. Ink disposed on the inner surface of the cap may then be transferred, at least in part, to the outer surface of the ferrule. The ferrule is often the portion of the writing instrument gripped by the consumer during writing. As a result, when a consumer removes the cap for writing, ink on the outer surface of the ferrule may be transferred to the consumer's fingers, which is undesirable from a consumer's point of view. Because permanent ink wets out a non-porous surface, as opposed to water based inks that bead on a non-porous surface, permanent ink on the ferrule is not necessarily apparent to the consumer. Thus, the consumer does not even realize that there was ink on an outer surface of the ferrule until after writing is complete and the ink has been transferred to the consumer's fingers. In a similar manner, ink from the inner cap surface may be further transferred to an aft end of the barrel when the cap is placed on the back of the barrel, for example when the cap is stored on the aft end of the barrel during writing.

The nib assemblies and writing instruments described herein advantageously prevent ink from being transferred from an inside of a cap to a gripping (or outer) surface of a ferrule, thereby preventing ink from being transferred to a consumer's fingers from the gripping surface when a consumer uses a writing instrument including same. Such ink transfer is prevented by providing a nib assembly including a ferrule having a double wall. The double-wall ferrule includes an inner ferrule wall and an outer ferrule wall forming a well therebetween. A writing nib is typically located inside the inner ferrule wall (at least when a writing instrument according to the invention is fully assembled). Any ink residue generated by the nib rubbing against an inner cap surface will be trapped between the inner ferrule wall and the outer ferrule wall and thus, the ink residue is prevented from transferring to a gripping area of the ferrule, such as in prior art writing instruments where ink is first transferred from the cap to an outer surface of an outer ferrule wall and then often transferred (yet again) to a consumer's fingers.

As illustrated, the writing instrument cap includes a first or inner cap wall and a second or outer cap wall, the inner cap wall being flush with an opening or bottom of the cap. However, the inner cap wall need not be flush with the bottom of the cap. Rather, the inner cap wall could be recessed within the cap, or the inner cap wall could extend outward, beyond the bottom of the cap. However, the inner cap wall can be visible to the consumer, which allows the consumer increased visual alignment between the cap and the nib when closing the marker, resulting in a reduction of the nib rubbing against the inner surfaces of the cap. Additionally, a seal is formed between the inner cap wall and the well between the inner ferrule wall and the outer ferrule wall.

Turning now to FIG. 1, one embodiment of a writing instrument 10 includes a barrel 12 having an opening at one end and a cap 14. A nib assembly 16 is coupled to the barrel 12 proximate the opening at the one end. The nib assembly 16 includes a ferrule 18 coupled to the barrel 12 and a writing nib 20 disposed at least partially within the ferrule 18. The writing nib 20 extends outward longitudinally, away from the barrel 12, being exposed for delivering ink to a substrate.

Figure 2:
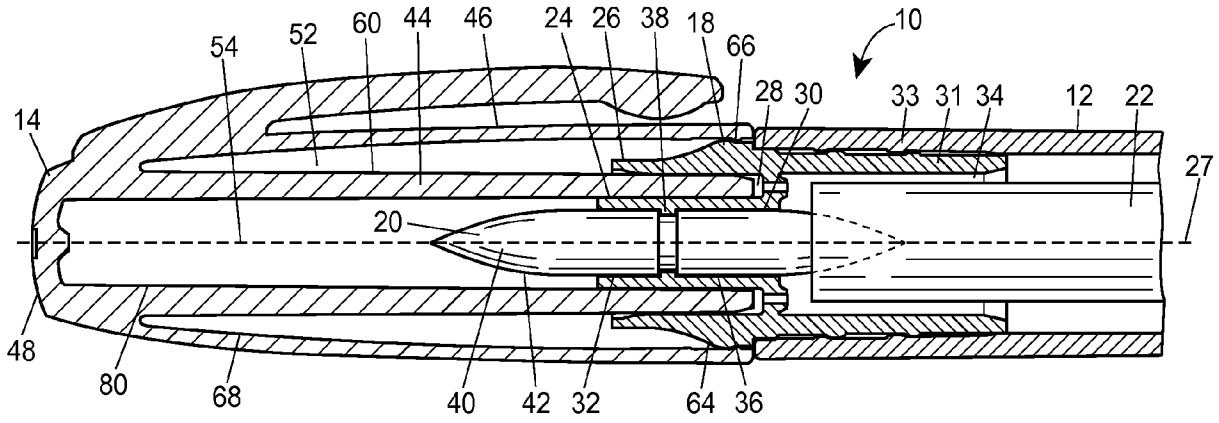
FIG. 2 is a cross-sectional view of the writing instrument of FIG. 1 with a cap in a closed position, coupled to the ferrule.
Figure 3:
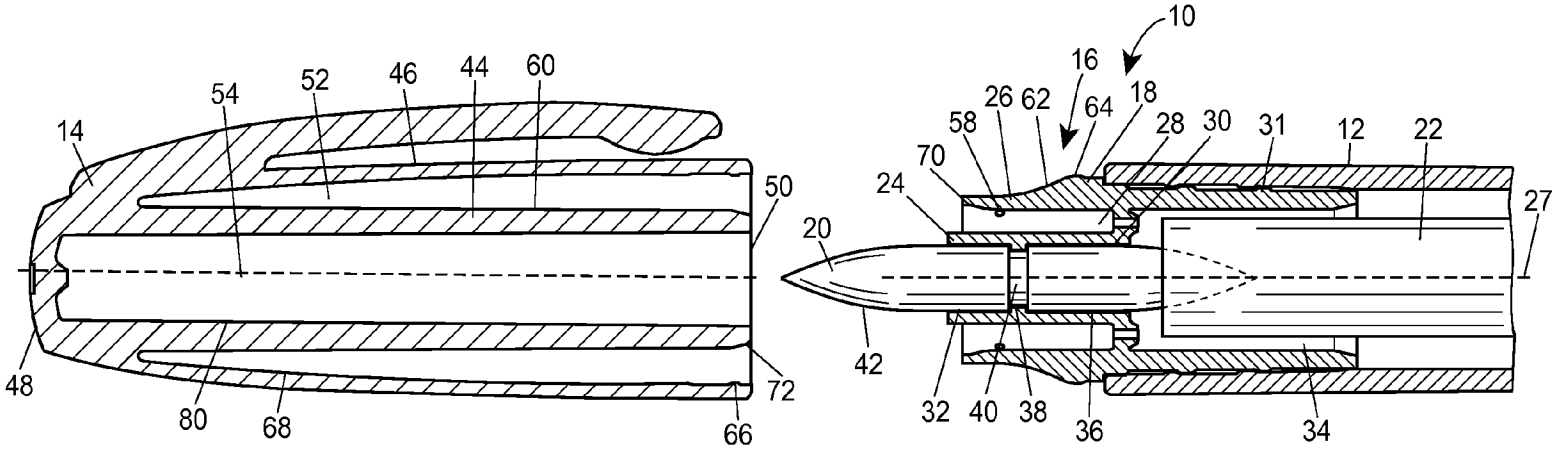
FIG. 3 is a cross-sectional view of the writing instrument of FIG. 1 with a cap in an open position, uncoupled from the ferrule exposing a writing nib.
Figure 4:
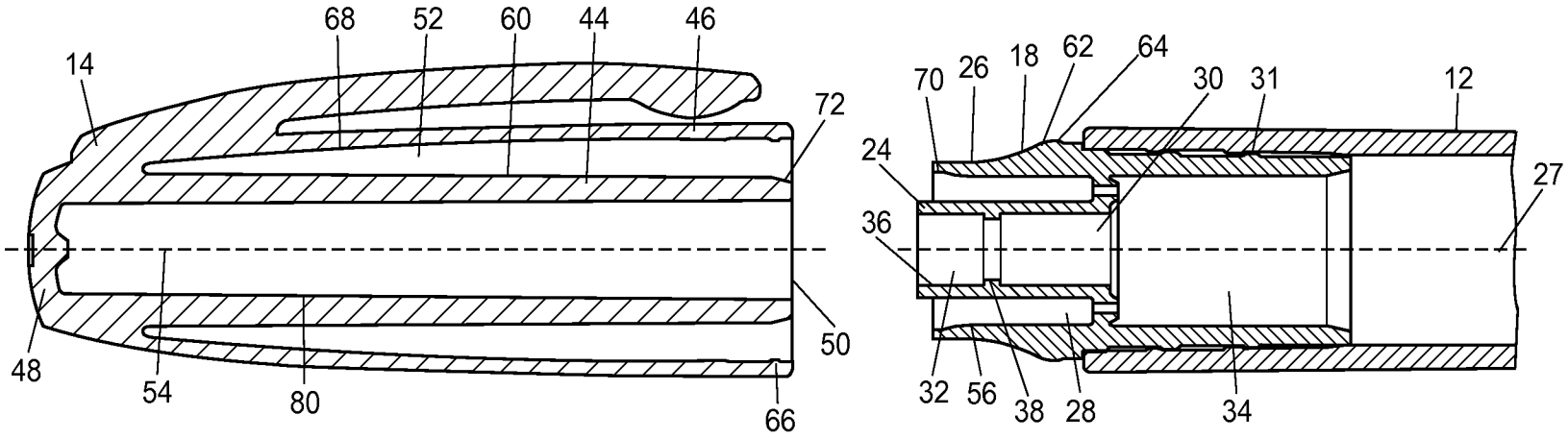
FIG. 4 is cross-sectional view of the writing instrument of FIG. 3 with the nib and ink reservoir removed.

As further illustrated in FIGS. 2 and 3, an ink reservoir 22 may be located within a hollow central core of the barrel 12 and the ink reservoir 22 may be in fluid communication with the writing nib 20. The ink reservoir 22 may be made of a fibrous material and serves as a reservoir capable of delivering ink to the writing nib. The writing nib 20 may be a ball point, an extruded plastic point, a fountain pen nib, or a porous plastic nib. The fibers of such porous plastic nibs are more frequently manufactured from a thermoplastic polymer, for example one or more of a polyester, a polypropylene, an acrylic, a nylon, or any combination thereof. Generally inks that are delivered from such porous plastic nibs have a viscosity in the range of about 1 cps (centipoises) to about 30 cps, more desirably a viscosity in the range of about 2 cps to about 25 cps, even more desirably a viscosity of between about 3 cps and about 20 cps, and most desirably a viscosity of about 5 cps.

Because the problem of ink transfer to a gripping portion of a ferrule is particularly problematic when writing instruments have relatively longer and more flexible writing nibs (such as are found in so-called "paint brush markers"), the writing nib 20 may be a porous plastic nib made of relatively long flexible nib fibers. One useful material for manufacturing the relatively long flexible nib fibers is nylon. Other materials having properties similar to nylon may also be used for manufacturing the relatively long flexible nib fibers. The writing nib 20 may also have a radiused outer surface to increase flexibility and to provide various stroke lengths during the writing process depending upon an amount of pressure applied by a consumer. The radiused outer surface may desirably have a radius in the range of about 15 mm to about 25 mm, for example about 20 mm. The writing nib 20 typically extends outward, beyond the ferrule 18 by a distance that adds additional flexibility. For example, the writing nib 20 may extend outward beyond the ferrule 18 by between about 8 mm and about 12 mm, and more particularly about 10.4 mm. The above described characteristics of the relatively long nib fibers give the writing nib 20 a great degree of flexibility with which a consumer may impart a wide variety of brush strokes of ink upon a substrate. The brush strokes delivered by such a porous writing nib may mimic paint brush strokes in both look and feel.

As illustrated, the ferrule 18 may include a first or inner ferrule wall 24 and a second or outer ferrule wall 26 that form a well 28 therebetween. The inner ferrule wall 24 generally has a free end that extends longitudinally farther outward than a free end of the outer ferrule wall 26. However, the free end of the inner ferrule wall 24 could be recessed within the outer ferrule wall 26, or the free end of the inner ferrule wall 24 could extend to a distance even with the free end of the outer ferrule wall 26. In any case, a well 28 will be formed between the inner ferrule wall 24 and the outer ferrule wall 26. In the illustrated embodiment, the inner ferrule wall 24 and the outer ferrule wall 26 are substantially cylindrical in shape, the inner ferrule wall 24 and the outer ferrule wall 26 being coaxial with a longitudinal axis 27 of the ferrule 18. In other embodiments, the inner ferrule wall 24 and the outer ferrule wall 26 may take on other cross-sectional shapes, such as oval, square, rectangular, polygonal or virtually any other cross-sectional shape. Moreover, in yet other embodiments the inner ferrule wall 24 and the outer ferrule wall 26 need not be coaxial. For example, in other embodiments, the inner ferrule wall 24 may be offset towards one side of the outer ferrule wall 26 such that the inner ferrule wall 24 would not share a longitudinal axis with the outer ferrule wall 26.

The ferrule 18 may include a central bore 30 having a first portion 32 that is sized and shaped to receive at least a portion of the writing nib 20 and a second portion 34 that is sized and shaped to receive a portion of the ink reservoir 22. The ferrule 18 holds the writing nib 20 and the ink reservoir 22 in fluid communication with one another so that ink may be delivered from the ink reservoir 22 to the writing nib 20, for example by capillary action. An inner surface 36 of the first portion 32 of the central bore 30 may include an inwardly projecting annular protrusion 38 that cooperates with a corresponding annular channel 40 disposed on an outer surface 42 of the writing nib 20 to positively locate the writing nib 20 within the central bore 30 of the ferrule 18. The annular channel 40 can also increase the flexibility of the writing nib 20 so as to enhance the brush-like application qualities thereof.

An outer surface of the ferrule 18 may include one or more annular protrusions 31 that cooperate with one or more inwardly projecting rings 33 on an inner surface of the barrel 12 to couple the ferrule 18 to the barrel 12. In some embodiments, the annular protrusions 31 and the inwardly projecting rings 33 may take the form of threads. In yet other embodiments, the ferrule 18 may be coupled to the barrel 12 by other means, such as epoxy, plastic welds, interference fits, or other connections.

The cap 14 may include a first or inner cap wall 44 and a second or outer cap wall 46. The inner cap wall 44 may join the outer cap wall 44 at a first end 48 of the cap 14. At a second end 50 of the cap 14, the inner cap wall 44 may be separated from the outer cap wall 46 by an annular space 52. In the illustrated embodiment, the inner cap wall 44 and the outer cap wall 48 are substantially cylindrical in shape and the inner cap wall 44 and the outer cap wall 48 are coaxial with a longitudinal axis 54 of the cap 14. In other embodiments, the inner cap wall 44 and the outer cap wall 46 may take on other cross-sectional shapes, such as oval, square, rectangular, polygonal, or virtually any other cross-sectional shape (typically, the cross-sectional shape of the cap 14 matches the cross-sectional shape of the ferrule 18). Moreover, in other embodiments the inner cap wall 44 and the outer cap wall 46 need not be coaxial as long as the inner cap wall 44 is sized and shaped to at least partially fit within the well 28 in the ferrule 18. For example, in other embodiments, the inner cap wall 44 may be offset towards one side of the outer cap wall 46 such that the inner cap wall 44 would not share a longitudinal axis with the outer cap wall 46. However, the inner cap wall 44 and the outer cap wall 46 must be sized and shaped to cooperate with size and shape of the ferrule 18. More specifically, the inner cap wall 44 should be sized to fit at least partially within the well 28 of the ferrule 18 when the cap 14 is in a closed position, thereby coupling the cap 14 to the ferrule 18 and preventing undesired ink transfer from the interior of the cap 14 to the exterior of the ferrule 18 in addition to protecting the writing nib 20 from accidental damage and reducing unnecessary evaporation of ink components from the writing nib 20. An inner surface 80 of the inner cap wall 44 forms a central blind bore that is longitudinally aligned with the longitudinal axis 27 of the ferrule 18 when the cap 14 is coupled to the ferrule 18. The blind bore may be coaxial with the annular space 52.

An inner surface 56 of the outer ferrule wall 26 may include an inwardly projecting protrusion 58 that cooperates with an outer surface 60 of the inner cap wall 44 to form a first seal between the ferrule 18 and the cap 14 when the cap 14 is in the closed position. An outer surface 62 of the outer ferrule wall 26 may include a raised annular projection 64 that cooperates with a corresponding inwardly projecting ring 66 on an inner surface 68 of the outer cap wall 46 to form a second seal between the ferrule 18 and the cap 14 when the cap 14 is in the closed position. The first and second seals may be reversed if desired. For example, the protrusion 58 may be located on an outer surface of the inner ferrule wall and the raised annular projection 64 and the inwardly projecting rings 66 may be reversed in other embodiments.

The inner surface 56 of the outer ferrule wall 26 may include a chamfered or angled portion 70 that cooperates with a corresponding angled surface 72 on the outer surface of the inner cap wall 44 to guide the inner cap wall 44 into the well 28 when the cap 14 is in the process of moving towards the closed position. The angled portion 70 may be angled relative to the longitudinal axis of the ferrule 18 by between about 2 degrees and about 40 degrees, preferably between about 5 degrees and about 25 degrees and more preferably about 15 degrees. The angled portion 70 forms a top opening of the well 28 that is radially larger than a bottom of the well, the angled portion 70 acting as a guiding surface that directs the inner cap wall 44 into the well when the cap 14 is in the process of being coupled to the ferrule 18.

Any ink that is transferred to the inner surface 80 of the inner cap wall 44 becomes trapped within the well 28 when the cap 14 is in the closed position, thereby preventing ink from becoming transferred to a gripping surface, such as the outer surface 62 of the outer ferrule wall 26. Thus, the disclosed nib assembly 16 prevents ink from adhering to a consumer's fingers when the consumer uncaps and uses the writing instrument.

The barrel 12 may also include a receptacle (not shown) at an aft end thereof. The receptacle may comprise a blind bore and a receptacle wall. The cap 14 may be removably coupled to the aft end of the barrel 12 when the cap 14 is not in the closed position to prevent loss of the cap 14. When the cap 14 is coupled to the aft end of the barrel 12, the inner cap wall 44 is at least partially disposed within the receptacle and the receptacle wall may be located between the inner cap wall 44 and the outer cap wall 46 (e.g., the receptacle wall may be at least partially disposed within the annular space 52), which prevents ink from transferring from the inner surface 80 of the inner cap wall 44 to an outer surface of the barrel 12, in a manner similar to that described above for the outer surface of the ferrule 18.

Figure 5:
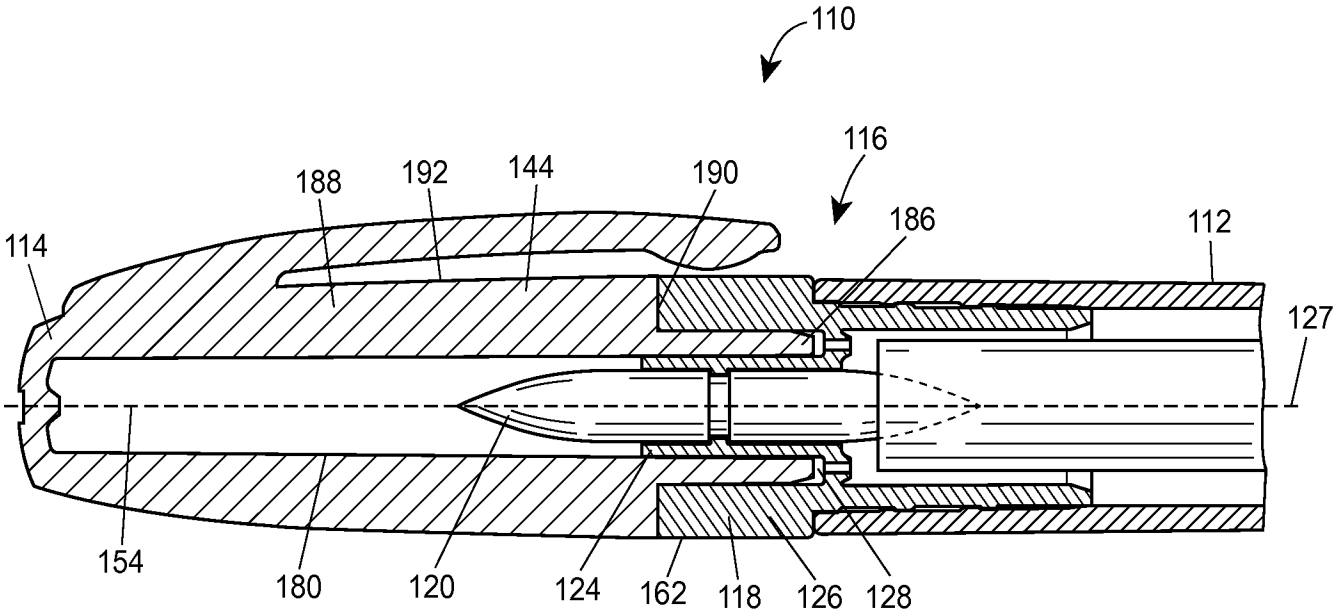
FIG. 5 is a cross-sectional view of another embodiment of a writing instrument having a nib assembly including ferrule having a double wall.

FIG. 5 illustrates an alternative embodiment of a writing instrument 110 having a nib assembly 116 that prevents ink from being transferred from an inside surface 180 of a cap 114 to a gripping surface 162 of a ferrule 118. Only the differences between the embodiment of FIG. 5 and the embodiment of FIGS. 1-4 will be discussed while like elements will have like reference numerals, simply increased by 100.

While the embodiment of FIG. 5 includes a ferrule 118 having an outer wall 126 and an inner wall 124 separated by a well 128, the cap 114 includes a single cap wall 144. That is, the cap 114 of the embodiment of FIG. 5 does not include an outer cap wall. However, as in the first embodiment, the single cap wall 144 includes a distal portion 186 that is sized and shaped to be at least partially disposed within the well 128. The distal portion 186 is typically connected to a wider proximal portion 188 at a shoulder 190 that is sized to cooperate with the outer ferrule wall 126 to form a substantially continuous outer instrument surface 192. Because the inner surface 180 of the single cap wall 144 is trapped within the well 128, ink on the inner surface 180 is prevented from being transferred to the outer surface 162 of the outer ferrule wall 126 and thus is prevented from being transferred to the fingers of a consumer using the writing instrument 110.

Similar to the embodiments illustrated above, the barrel 112 may also include a receptacle (not shown) at an aft end thereof. The receptacle may comprise a blind bore and a receptacle wall. The cap 114 may be removably coupled to the aft end of the barrel 112 when the cap 114 is not in the closed position to prevent loss of the cap 114. When the cap 114 is coupled to the aft end of the barrel 112, the distal portion 186 of the cap wall 144 is at least partially disposed within the receptacle such that the inner surface 180 of the cap wall 144 is separated from an outer surface of the barrel 112 by the receptacle wall, which prevents ink from transferring from the inner surface 180 of the cap wall 144 to an outer surface of the barrel 112.

The caps 14, 114 and ferrules 18, 118 described herein are preferably made from a thermoplastic material during an injection molding process. Suitable thermoplastic materials include polypropylene, polyethylenes, nylons, and the like. Other suitable materials include metals (e.g., steel, aluminum, and plated metals), glass, ceramics, and composites.

The nib assemblies described herein may be incorporated into virtually any type of writing instrument, such as fountain pens, felt-tip pens, ball point pens, capillary action markers, and particularly brush-tip markers such as permanent ink brush tip markers, water based ink brush tip markers, and brush tip makeup or body art markers.

The nib assemblies described herein prevent ink disposed on an inner cap surface from being transferred to an outer gripping surface where the ink could further be transferred to the fingers of a user. As a result, a consumer has a more pleasurable writing experience and a lower chance of unintentionally transferring ink from the fingers to the substrate.

While embodiments of this invention have been disclosed in considerable detail herein for purposes of illustration, it will be understood by those skilled in the art that many of those details may be varied without departing from the spirit and scope of the invention. Accordingly, only such limitations as appear in the appended claims should be placed on the invention.

The invention claimed is:

1. A writing instrument comprising:

a barrel having an opening at a first end and a hollow central core;

an ink reservoir disposed within the hollow central core;

a ferrule having a first ferrule end and a second ferrule end, the ferrule being coupled to the barrel proximate the opening, the ferrule having a double wall, the double wall including an inner wall and an outer wall, the space between the inner wall and the outer wall forming a well with an opening at the first ferrule end, and the inner ferrule wall comprising a central bore;

a nib disposed at least partially within the central bore the nib being in fluid communication with the ink reservoir; and a cap having a first cap end, a second cap end, a first cap wall, and a second cap wall, the cap having an opening at the first cap end formed by the first cap wall, a free end of the first cap wall being located proximate the opening and being sized and shaped to fit within the well between the inner ferrule wall and the outer ferrule wall, and the second cap wall being disposed outside of the well, when the cap is coupled to the ferrule.

2. The writing instrument of claim 1, wherein the first cap wall is an inner cap wall and the second wall is an outer cap wall.

3. The writing instrument of claim 1, wherein the inner cap wall is flush with an opening of the cap.

4. The writing instrument of claim 1, wherein the ink reservoir comprises a fibrous material.

5. The writing instrument of claim 4, wherein the ink reservoir comprises ink having a viscosity in the range of about 1 cps to about 30 cps.

6. The writing instrument of claim 1, wherein the barrel includes an inwardly projecting ring proximate the opening and the ferrule includes a corresponding recess or outwardly projecting protrusion that cooperates with the inwardly projecting ring on the barrel to couple the barrel to the ferrule.

7. The writing instrument of claim 1, wherein an inner surface of the outer ferrule wall includes an inwardly projecting protrusion that interacts with a corresponding recess or outwardly projecting protrusion on the outer surface of the first cap wall to form a first seal between the cap and the ferrule when the cap is coupled to the ferrule.

8. The writing instrument of claim 1, wherein an outer surface of the outer ferrule wall includes a raised annular projection and an inner surface of the second cap wall includes a corresponding recess or inwardly projecting ring that cooperates with the raised annular projection on the outer surface of the outer ferrule wall to couple the cap to the ferrule to form a second seal between the cap and the ferrule when the cap is coupled to the ferrule.

9. The writing instrument of claim 1, wherein the writing nib is flexible.

10. The writing instrument of claim 9, wherein the writing nib comprises a porous plastic nib.

11. The writing instrument of claim 1, further comprising an annular ridge disposed within the central bore, the annular ridge cooperating with a corresponding annular recess formed in an outer surface of the nib to couple the nib to the ferrule within the inner ferrule wall.

* * * * *